US009229417B2

(12) United States Patent
Satoh

(10) Patent No.: US 9,229,417 B2
(45) Date of Patent: Jan. 5, 2016

(54) IMAGE FORMING APPARATUS INCLUDING WASTE TONER CONTAINER WITH GUIDE UNIT

(71) Applicant: Atsushi Satoh, Kanagawa (JP)

(72) Inventor: Atsushi Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/189,096

(22) Filed: Feb. 25, 2014

(65) Prior Publication Data

US 2014/0270882 A1 Sep. 18, 2014

(30) Foreign Application Priority Data

Mar. 15, 2013 (JP) ..... 2013-052801

(51) Int. Cl.
*G03G 21/12* (2006.01)

(52) U.S. Cl.
CPC ..... *G03G 21/12* (2013.01); *G03G 2221/1884* (2013.01)

(58) Field of Classification Search
CPC ..... G03G 21/12; G03G 21/1647; G03G 2221/1884
USPC ..... 399/360
See application file for complete search history.

(56) References Cited

U.S. PATENT DOCUMENTS

2007/0292179 A1* 12/2007 Kudo ..... 399/360
2009/0136259 A1* 5/2009 Ito
2010/0303479 A1* 12/2010 Itoh et al. ..... 399/21
2011/0236056 A1* 9/2011 Mori et al.

FOREIGN PATENT DOCUMENTS

JP 2009063765 A * 3/2009
JP 2009-223182 10/2009
JP 2010-127989 6/2010

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

An image forming apparatus includes an image bearer; a cleaning unit configured to remove waste toner on the image bearer; a waste toner container configured to be detachably attached to the image forming apparatus and to store the waste toner removed by the cleaning device; and a support member configured to support the waste toner container. The support member is provided with a guide unit thereon that guides the waste toner container in attachment and detachment directions, the guide unit includes a side guide plate that guides each of sides of the waste toner container in the attachment and detachment directions, a guide plate arranged on entrance side of the side guide plate in the attachment direction of the waste toner container, and the guide plate includes an inclined guide surface that guides the waste toner container onto the support member.

17 Claims, 6 Drawing Sheets

IMAGE FORMING APPARATUS INCLUDING WASTE TONER CONTAINER WITH GUIDE UNIT

CROSS-REFERENCE TO RELATED APPLICATIONS

The present application claims priority to and incorporates by reference the entire contents of Japanese Patent Application No. 2013-052801 filed in Japan on Mar. 15, 2013.

BACKGROUND OF THE INVENTION

1. Field of the Invention

The present invention relates to an electrophotographic image forming apparatus, such as a copier, a facsimile machine, a printer, or a multifunction peripheral (MFP) having functions of at least two of these devices, that develops a latent image on an image bearer to form a toner image.

2. Description of the Related Art

Electrophotographic image forming apparatuses that transfer a toner image formed on a photoconductor serving as an image bearer onto a recording medium, such as a sheet, have been known. Such an image forming apparatus includes a cleaning device that removes residual toner remaining on the photoconductor after the image is transferred. Furthermore, image forming apparatuses that transfer a toner image formed on a photoconductor to an intermediate transfer member, such as an intermediate transfer belt, as primary transfer, and subsequently transfer the toner image borne on the intermediate transfer belt through the primary transfer onto a recording medium, such as a sheet, as secondary transfer have been known. Such an image forming apparatus includes cleaning devices that remove residual toner remaining on the photoconductor and the intermediate transfer belt after the primary transfer and the secondary transfer are completed.

In some cases, the residual toner removed by the cleaning device may be returned to a developing device and may be reused. However, in many cases, the residual toner is accumulated, as waste toner, by a waste toner collecting device to a waste toner container provided at an appropriate position in a main body of the apparatus. In particular, in the case of color image forming apparatuses, toner collected from the intermediate transfer belt include toner of different colors, so that all of the toner is not returned to and reused by the developing device or the like, but is conveyed to and accumulated in, as waste toner, a waste toner container.

In an image forming apparatus including the waste toner container, as described in Japanese Patent Application Laid-open No. 2010-127989, if the waste toner container is filled with toner, machines need to be stopped in order to replace the waste toner container with new one. It is advantageous if the frequency of replacement of the waste toner container can be reduced. Therefore, there is a need to increase the capacity of the waste toner container and practical implementation has been performed. However, if the size of the waste toner container is increased, an installation space is increased and handling in attaching and detaching the waste toner container may become difficult. Therefore, a guide is arranged on a support member of the waste toner container in an attachment/detachment direction of the waste toner container so that the waste toner container can be attached and detached easily.

However, a larger guide is needed for a larger waste toner container, so that the size of the support member also increases with an increase in the size of the support member.

Therefore, there is a need to provide an image forming apparatus that can cope with the above disadvantages and that enables to easily attach and detach the waste toner container without increasing the size of a positioning member even when the size of the waste toner container is increased.

SUMMARY OF THE INVENTION

There is a need to at least partially solve the problems in the conventional technology.

According to one aspect of the present invention, provided is an image forming apparatus including: an image bearer; a cleaning unit configured to remove waste toner on the image bearer; a waste toner container configured to be detachably attached to the image forming apparatus and to store the waste toner removed by the cleaning device; and a support member configured to support the waste toner container. Wherein the support member is provided with a guide unit thereon that guides the waste toner container in attachment and detachment directions, the guide unit includes a side guide plate that guides each of sides of the waste toner container in the attachment and detachment directions, a guide plate arranged on entrance side of the side guide plate in the attachment direction of the waste toner container, and the guide plate includes an inclined guide surface that guides the waste toner container onto the support member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings.

Figure 1:
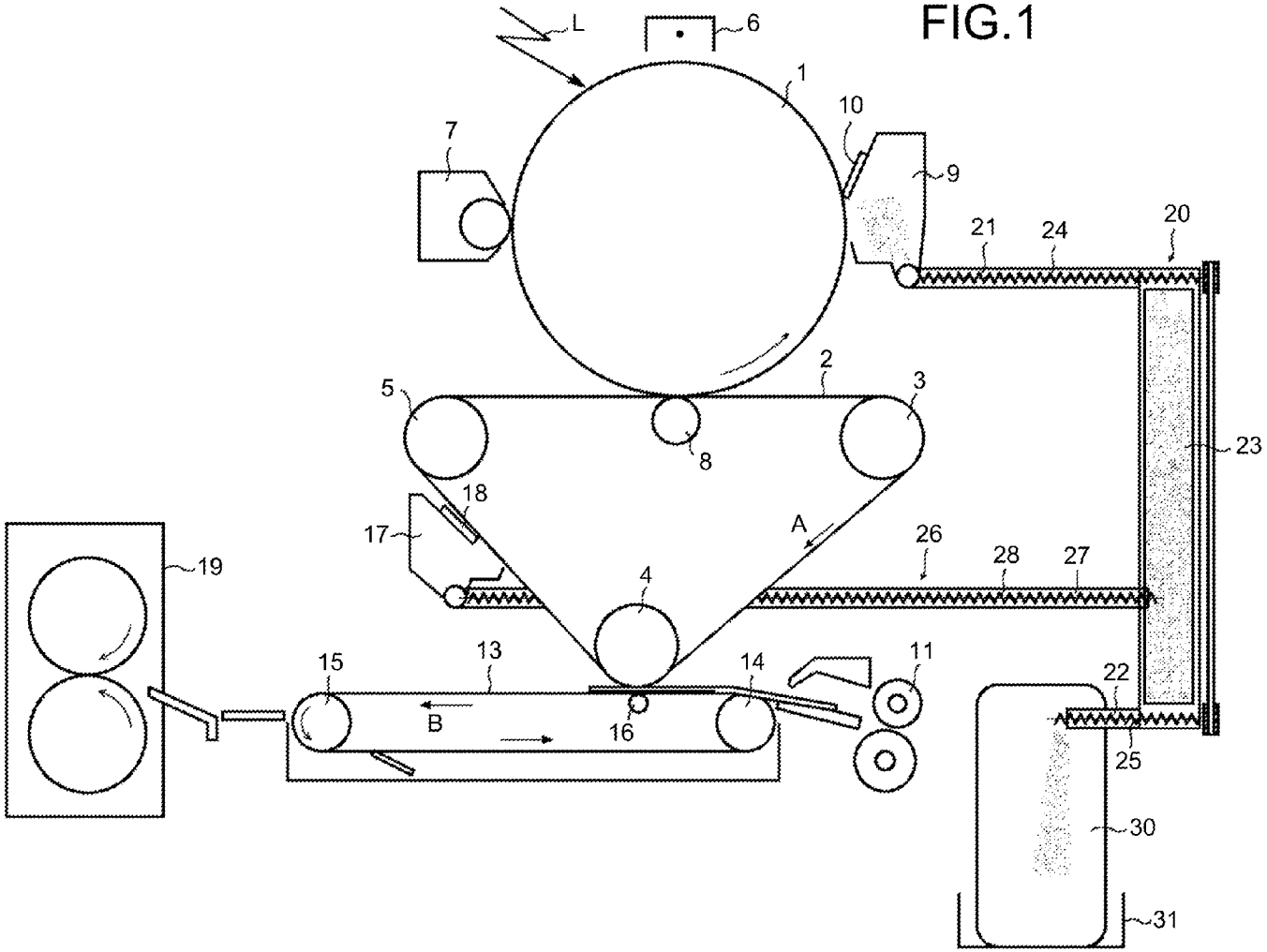
FIG. 1 is a schematic diagram illustrating an example of an image forming apparatus including a waste toner container.

FIG. 1 is a schematic diagram illustrating an example of an image forming apparatus including a waste toner collecting device. The image forming apparatus illustrated in FIG. 1 is an apparatus using an intermediate transfer system and includes a drum-shaped photoconductor 1 serving as an image bearer arranged inside a main-body housing. An intermediate transfer belt 2, which is an endless belt stretched around multiple support members including support rollers 3, 4, and 5, is arranged opposite to the photoconductor 1, and is rotated in an arrow A direction along with rotation of one of the support rollers 3, 4, and 5 serving as a driving roller.

The photoconductor 1 is rotated counterclockwise in FIG. 1, and the surface of the image bearer is uniformly charged with a predetermined polarity by a charging device 6. An exposing device (not illustrated) applies optically-modulated laser light L to the charged surface, so that an electrostatic latent image corresponding to write information is formed on the surface of the photoconductor 1. In the example illustrated in FIG. 1, a corona discharger is used as the charging device 6. However, a charging device including a charging roller or a charging blade may be used. Similarly, while an exposing device including a laser writing device that emits the laser light L is used in the image forming apparatus illustrated in FIG. 1, an exposing device including a light emitting diode (LED) array and an imaging means may be used.

The electrostatic latent image formed on the photoconductor 1 is developed into a toner image when passing by a developing device 7. A transfer roller 8, which is an example of a primary transfer means, is arranged on the inner side of the intermediate transfer belt 2 being the endless belt so as to face the photoconductor 1 across the intermediate transfer belt 2. The transfer roller 8 comes in contact with a back side of the intermediate transfer belt 2, so that an appropriate transfer nip is ensured between the photoconductor 1 and the intermediate transfer belt 2.

A transfer voltage with a polarity opposite to the polarity of charged toner of the toner image formed on the photoconductor 1 is applied to the transfer roller 8. Therefore, a transfer electric field is formed between the photoconductor 1 and the intermediate transfer belt 2, so that the toner image on the photoconductor 1 is electrostatically transferred to the intermediate transfer belt 2 that is rotated in synchronization with the photoconductor 1. Some of the toner usually remains on the photoconductor 1 after the toner image is transferred, and the residual toner adhering to the surface of the photoconductor 1 is removed by a cleaning device 9. The cleaning device 9 described herein includes, as a cleaning means, a cleaning blade 10 that wipes off the non-transferred toner adhering to the surface of the photoconductor 1, and the toner wiped off by the cleaning blade 10 is conveyed to a waste toner container 30 via a first waste toner conveying unit 20.

A secondary transfer means, which transfers the toner image that has been transferred on the intermediate transfer belt 2 to a recording medium P such as transfer sheet or a resin sheet, is arranged below the intermediate transfer belt 2. The secondary transfer means of the embodiment includes a secondary transfer belt 13 that is stretched between transfer support rollers 14 and 15 and is rotated in an arrow B direction in synchronization with the intermediate transfer belt 2. A roller 16 is arranged on the inner side of the secondary transfer belt 13 so as to face the support roller 4 of the intermediate transfer belt 2. The roller 16 presses the secondary transfer belt 13 against the intermediate transfer belt 2. The secondary transfer means may include a secondary transfer roller instead of the secondary transfer belt.

A transfer voltage with a polarity opposite to the polarity of charged toner of the image on the intermediate transfer belt 2 is applied to the secondary transfer belt 13. Therefore, a transfer electric field is formed between the intermediate transfer belt 2 and the secondary transfer belt 13. Accordingly, the image formed of superimposed toner images on the intermediate transfer belt 2 is electrostatically transferred to the recording medium P when the image on the intermediate transfer belt 2 reaches a transfer position between the intermediate transfer belt 2 and the secondary transfer belt 13. As described above, the secondary transfer means functions to electrostatically transfer the toner image, which has been transferred from the photoconductor 1 to the intermediate transfer belt 2, to the recording medium P.

Non-transferred toner adhering to the surface of the intermediate transfer belt 2 after the image is transferred to the recording medium P is removed by an intermediate transfer cleaning device 17 together with paper dust or the lie, so that the surface of the intermediate transfer belt 2 is cleaned. The intermediate transfer cleaning device 17 includes a cleaning blade 18 that wipes off the non-transferred toner adhering to the surface of the intermediate transfer belt 2, and the toner wiped off by the cleaning blade 18 is conveyed to the waste toner container 30 via a second waste toner conveying unit 26.

In the image forming apparatus configured as above, when image forming operation is started and a toner image is formed on the surface of the photoconductor 1 through a charging process, an exposing process, and a developing process, the toner image is transferred to the intermediate transfer belt 2 by the transfer roller 8 and then conveyed to a secondary transfer position. Meanwhile, the recording medium P is fed from a sheet feed unit (not illustrated), abutted against a timing conveying roller 11, and then conveyed to the secondary transfer position in synchronization with the toner image on the intermediate transfer belt 2, so that the toner image is transferred to the recording medium P due to the action of the secondary transfer belt 13. The recording medium P on which the toner image has been transferred is conveyed by the secondary transfer belt 13 and then separated from the secondary transfer belt 13. Subsequently, a fixing device 19 fixes the toner image to the recording medium P and the recording medium P is discharged to the outside of the apparatus.

In the image forming apparatus as described above, toner remaining on the surface of the photoconductor 1 after the primary transfer is wiped off by the cleaning blade 10 of the cleaning device 9, and is conveyed from the cleaning device 9 to the waste toner container 30 by the first waste toner conveying unit 20. The first waste toner conveying unit 20 is arranged such that the waste toner container 30 can be supported by a support member 31 below the cleaning device 9 in the direction of gravity. The first waste toner conveying unit 20 includes a first horizontal path 21 extending in the horizontal direction, a second horizontal path 22 extending toward the waste toner container 30, and a vertical path 23 connecting the first horizontal path 21 and the second horizontal path 22. Toner from the cleaning device 9 is conveyed to the waste toner container 30 via the first horizontal path 21, the vertical path 23, and the second horizontal path 22.

Toner remaining on the surface of the intermediate transfer belt 2 after the second transfer is wiped off by the cleaning blade 18 of the intermediate transfer cleaning device 17, and is conveyed to the vertical path 23 of the first waste toner conveying unit 20 via a horizontal path 27 of the second waste toner conveying unit 26. Then, the waste toner is conveyed to the waste toner container 30 via the vertical path 23 and the second horizontal path 22 of the first waste toner conveying unit 20. Incidentally, conveying screws 24, 25, and 28 are arranged in the first horizontal path 21 and the second horizontal path 22 of the first waste toner conveying unit 20 and the horizontal path 27 of the second waste toner conveying unit 26, respectively.

Figure 2:
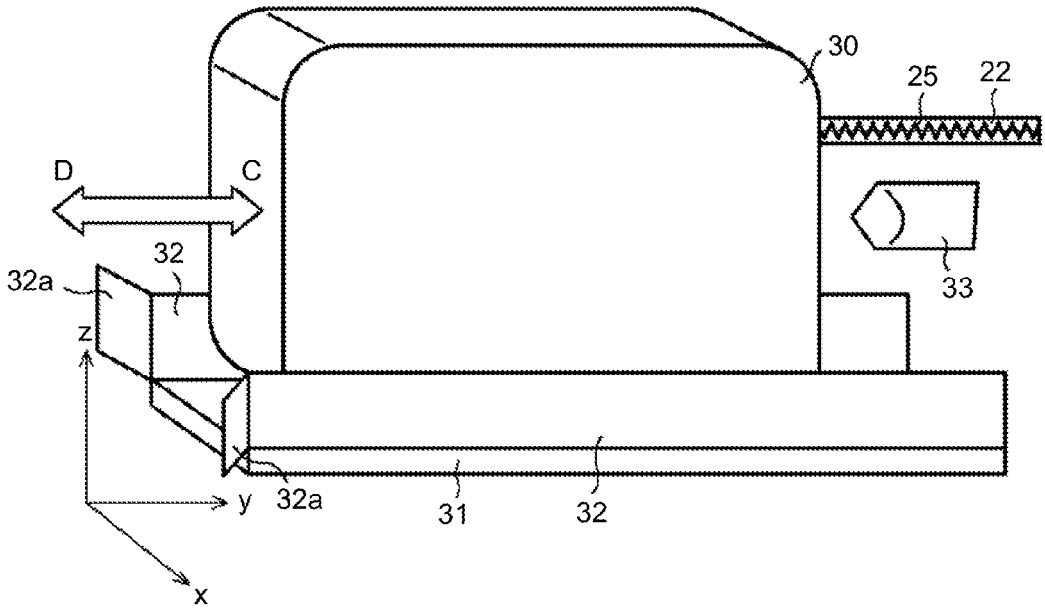
FIG. 2 is a perspective view illustrating the waste toner container attached to a main body of the image forming apparatus according to an embodiment of the present invention.

FIG. 2 is a perspective view illustrating the waste toner container 30 detachably attached to a main body of the apparatus.

In FIG. 2, when the waste toner container 30 is filled with waste toner, the waste toner container 30 needs to be replaced with new one. At the time of replacement, an operator pulls out the waste toner container 30 in an arrow D direction (detachment direction), so that the waste toner container 30 is carried to the outside of the image forming apparatus while sliding on the support member 31. After the replacement, the operator slides a new waste toner container 30 on the support member 31 in an arrow C direction to attach the waste toner container 30 to the image forming apparatus.

At the time of attachment, the waste toner container 30 needs to be set at a correct position at which the second horizontal path 22 is inserted in the container without deviation. Therefore, the position of the waste toner container 30 in the x direction is controlled and determined by a positioning protrusion 33, which serves as a positioning means that determines the correct position and which is arranged behind the waste toner container 30 along the attachment direction. Furthermore, the position of the waste toner container 30 in the y direction is controlled and determined by side guide plates 32 that stand on both sides of the support member 31. Moreover, a bottom portion of the waste toner container 30 and the support member 31 come in contact with each other, so that the position of the waste toner container 30 in the z direction is controlled and determined.

Figure 3:
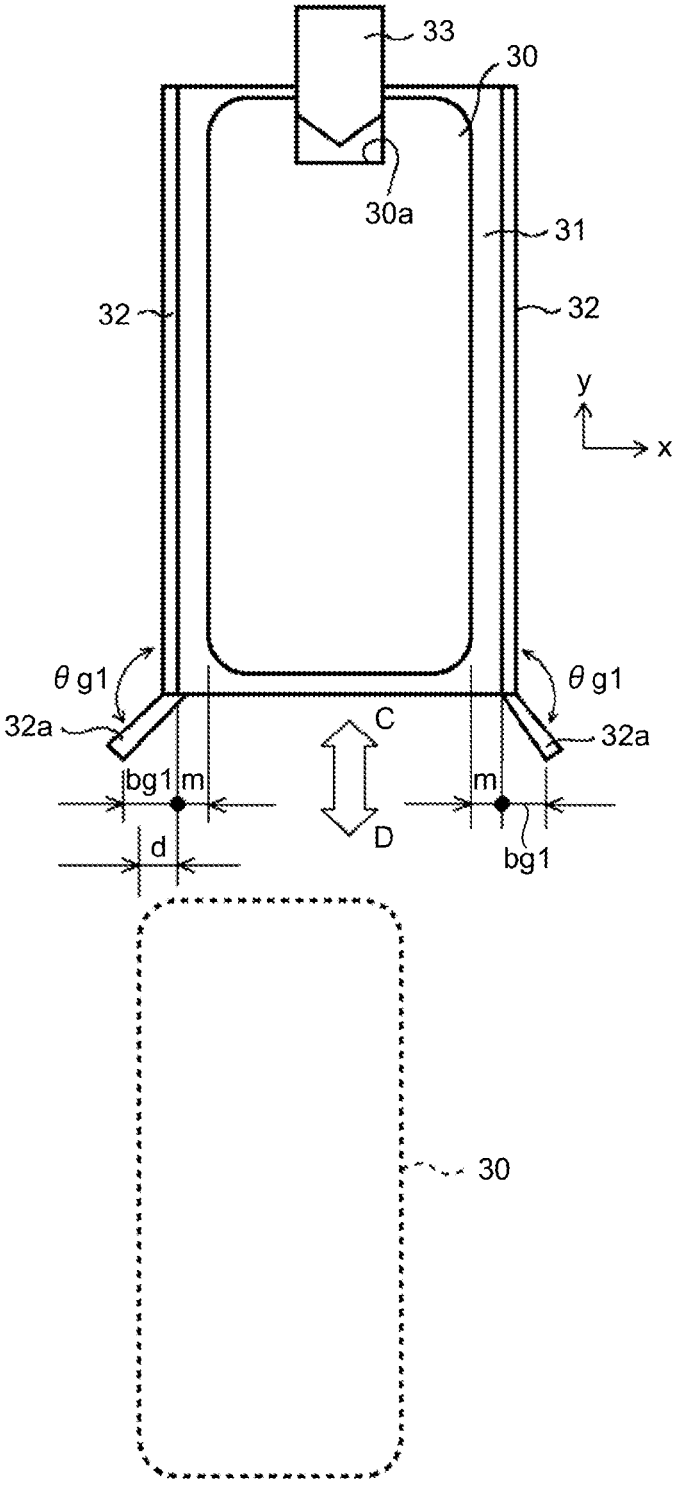
FIG. 3 is an explanatory top view of the waste toner container supported by a support member illustrated in FIG. 2.

FIG. 3 is an explanatory top view of the waste toner container 30 supported by the support member 31.

In FIG. 3, a positioning recess 30*a* is formed on a front side of the waste toner container 30 in the attachment direction so as to face the positioning protrusion 33. The waste toner container 30 is configured such that margins m of about a few millimeters (mm) in the x direction are ensured with respect to the side guide plates 32, and the position of the waste toner container 30 in the x direction is controlled to a certain extent before precise positioning is performed by fitting between the positioning protrusion 33 and the positioning recess 30*a*.

However, the size of the margins m is controlled by a width between the side guide plates 32. If the margins m are reduced in the width between the side guide plates 32, it becomes difficult to attach the waste toner container 30. However, if the margins m are increased, the size of the support member 31 increases and it becomes difficult to fit the positioning protrusion 33 to the positioning recess 30*a*.

Therefore, inclined guide plates 32*a* for guiding the waste toner container 30 onto the support member 31 are arranged on entrance sides of the side guide plates 32 of the support member 31 in the attachment direction of the waste toner container 30. The guide plates 32*a* are guide surfaces that are inclined outward such that the front edges thereof in the arrow D direction are located on the outermost side. In the embodiment, as illustrated in FIG. 3, the inclined guide plates 32*a* are formed in the shape like the Chinese character for eight. Incidentally, the guide plates 32*a* are structured with guide angles θg1 and guide widths bg1, and the guide plates 32*a* may or may not be bilaterally symmetric. The side guide plates 32 and the guide plates 32*a* serve as a guide means of the embodiment.

At the time of attachment, even when a side surface of the waste toner container 30 is located on the outside of one of the side guide plates 32 as indicated by a dashed line in FIG. 3, if a distance d between the side surface of the container and the side guide plate 32 is shorter than the guide width bg1, the waste toner container 30 is attached while coming in contact with the guide plate 32*a*. Subsequently, the positioning protrusion 33 is fitted to the positioning recess 30*a*, so that the waste toner container 30 can easily be attached to the correct position.

Incidentally, to facilitate the attachment operability of the waste toner container 30, it may be possible to increase the sizes of the guide plates 32*a*. However, if the sizes of the guide plates 32*a* are increased, the size of the support member 31 is also increased, resulting in the increased size and costs of the apparatus.

Figure 4:
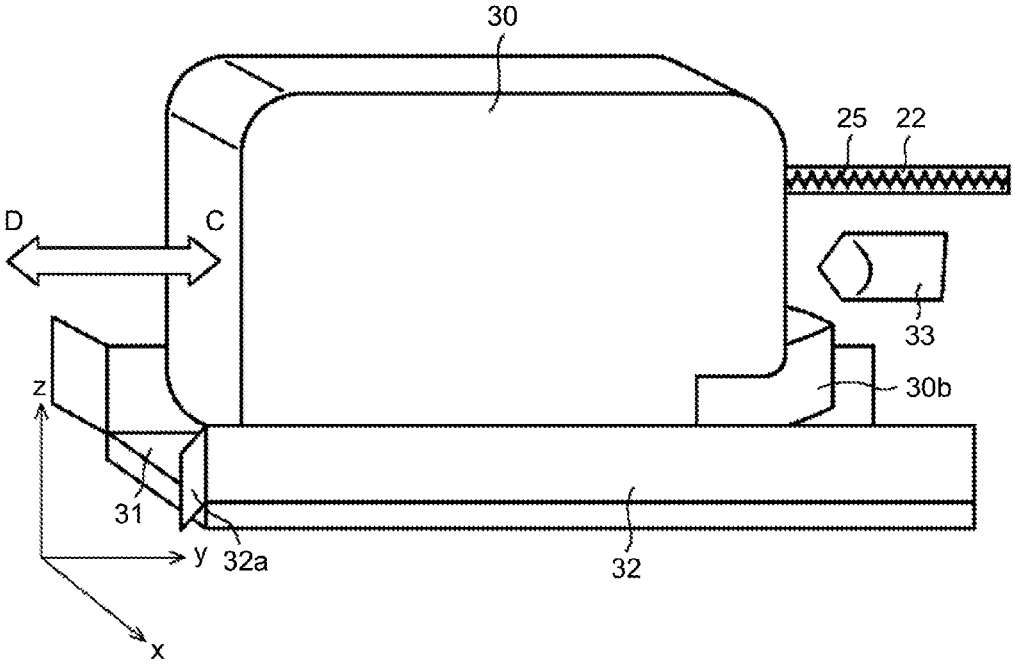
FIG. 4 is a perspective view of a waste toner container attached to a main body of an image forming apparatus according to another embodiment of the present invention.
Figure 5:
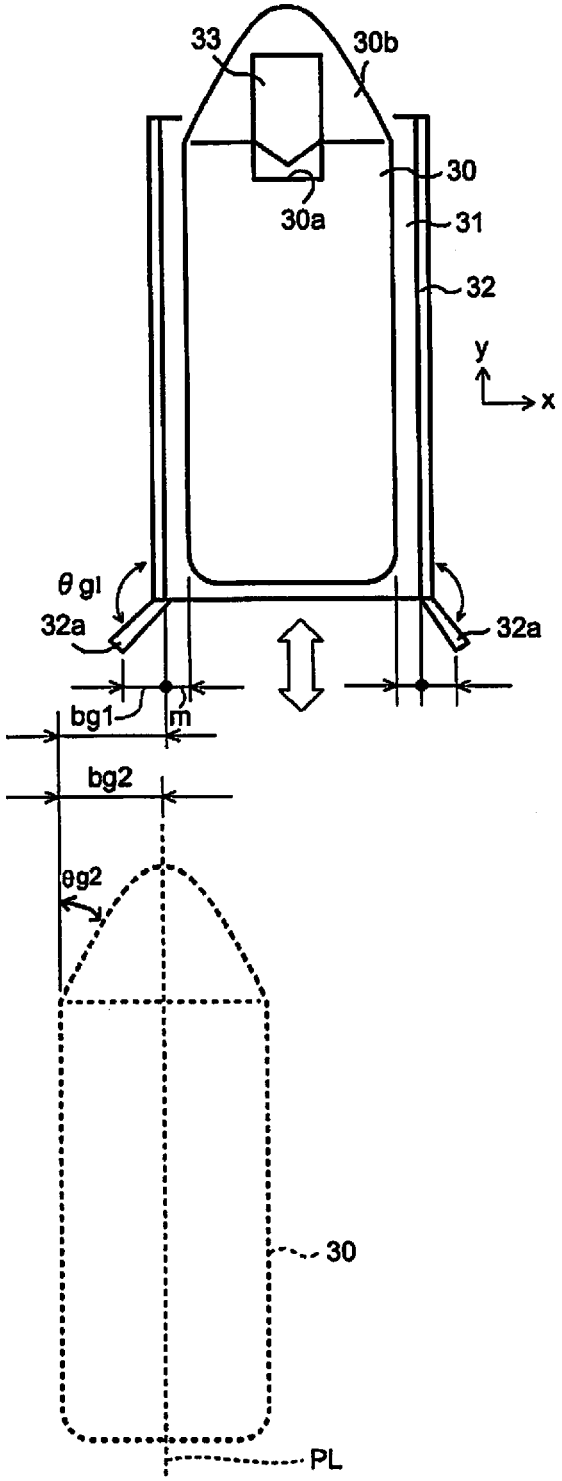
FIG. 5 is a top view of the waste toner container supported by a support member illustrated in of FIG. 4.

Therefore, as illustrated in FIG. 4 and FIG. 5, a container guide 30*b* is arranged on the front side of the waste toner container 30 in the attachment direction. FIG. 4 is a perspective view of the waste toner container 30 attached to the main body of the apparatus according to another embodiment. FIG. 5 is a top view of the waste toner container 30.

In FIG. 4 and FIG. 5, the container guide 30*b* arranged on the rear side of the waste toner container 30 protrudes in the attachment direction, has a leading end in a curved shape, and is structured with a guide angle θg2 and a guide width bg2. By providing the container guide 30*b* protruding in a streamlined shape as described above, a margin used for attachment to the support member 31 becomes a sum of the guide width bg1 and the guide width bg2. Therefore, it becomes possible to more easily attach the waste toner container 30 compared with a structure including only the guide plates 32*a*.

As described above, according to the embodiment, the width that enables easier attachment when the container is to be attached becomes the sum of the guide width bg1 of the guide plates 32*a* of the side guide plates 32 and the guide width bg2 of the container guide 30*b*, so that the margin for the attachment is increased. Therefore, even when the container is so heavy that an operator cannot handle it stably, it becomes possible to easily attach the container to the image forming apparatus.

Furthermore, when the waste toner container 30 is made of resin, the container guide 30*b* may be separated with respect to a parting line PL of the waste toner container 30. Furthermore, as illustrated in FIG. 5, the waste toner container 30 may be formed in a bottle shape by combining plates and resin components. Moreover, if blow molding is employed, the bottle shape can be formed of a single component, so that costs can be reduced compared with the structure in which plates and resin components are combined. When the blow molding as described above is employed, and if a corner at a right angle is to be formed, the resin may not reach the corner and the thickness of the corner may be reduced. Therefore, by separating the container guide 30*b* with respect to the parting line PL, a sharp corner is not formed, so that it becomes possible to prevent uneven thickness of the waste toner container 30 due to the blow molding.

As described above, when the waste toner container 30 is formed by the blow molding, if the container guide 30*b* is provided on the waste toner container 30, it becomes possible to improve the attachability of the waste toner container 30 and prevent uneven thickness of the waste toner container 30.

Figure 6:
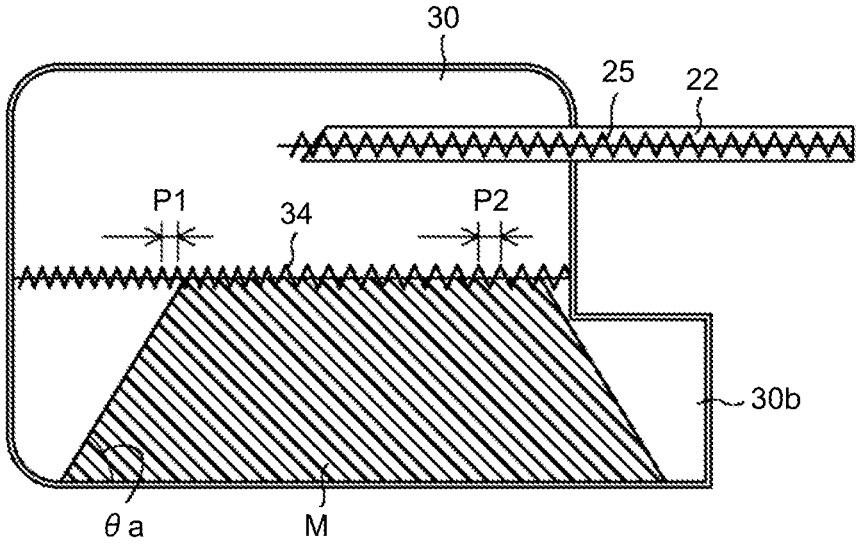
FIG. 6 is a cross-sectional view of the interior of the waste toner container including a container guide.

FIG. 6 is a cross-sectional view of the interior of the waste toner container 30 including the container guide 30*b*.

In FIG. 6, when the container guide 30*b* is added to the waste toner container 30, the way that the waste toner is accumulated in the waste toner container 30 may be changed and a filling rate may be reduced.

Therefore, a screw pitch and a shape of a screw 34 arranged inside the waste toner container 30 are selected depending on the shape of the container guide 30*b*.

Assuming that a waste toner heap M with a repose angle θa is formed with waste toner conveyed to the waste toner container 30 and the screw 34 cuts into and levels the waste toner heap M, the waste toner container 30 can be uniformly filled with the waste toner. However, the inner volume of the waste toner container 30 changes depending on the shape of the container guide 30*b*, so that the way of filling is changed. Therefore, by changing the shape of the screw 34 inside the bottle, for example, by changing the screw pitch between the rear end and the front end of the container, it becomes possible to uniformly fill the waste toner container 30 with the waste toner. When the volume of the waste toner container 30 on the container guide 30*b* side is increased because of the container guide 30*b*, a screw pitch P2 on the rear side that is the container guide 30*b* side is increased compared with a screw pitch P1 on the opposite side. Consequently, it becomes possible to improve the capability to convey the waste toner on the container guide 30*b* side, enabling to uniformly fill the waste toner container 30 with the waste toner.

While preferred embodiments of the present invention are explained above, the present invention is not limited to these embodiments. For example, while the image forming apparatus illustrated in FIG. 1 employs a monochrome system including a single photoconductor, the present invention may be applied to a color image forming apparatus including multiple photoconductors.

According to an embodiment, even when the size of the waste toner container is increased and the waste toner container is located on the outside of the support member at the time of attachment or detachment, the waste toner container can be housed in the support member by the guide means, and therefore, the waste toner container can be attached and detached easily.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a waste toner container configured to be detachably attached to the image forming apparatus and to store a waste toner; and a support member configured to support the waste toner container, wherein the support member is provided with a guide unit thereon that guides the waste toner container in attachment and detachment directions, the guide unit includes a side guide plate that guides each of sides of the waste toner container in the attachment and detachment directions, a guide plate arranged on entrance side of the side guide plate in the attachment direction of the waste toner container, the guide plate includes an inclined guide surface that guides the waste toner container onto the support member, and a positioning unit at a center of a front side of the waste toner container in the attachment direction so as to cause the waste toner container guided onto the support member to be positioned at a correct position.

2. The image forming apparatus according to claim 1, wherein the positioning unit includes a positioning protrusion; and a positioning recess that is fitted to the positioning protrusion.

3. The image forming apparatus according to claim 1, wherein the waste toner container includes a container guide, the container guide protrudes from a front side of the waste toner container in the attachment direction.

4. The image forming apparatus according to claim 3, wherein the waste toner container is formed by a blow molding process.

5. The image forming apparatus according to claim 4, wherein a shape of the container guide is symmetrical with respect to a parting line where the two halves of a mold, from the blow molding process, separate.

6. The image forming apparatus according to claim 3, further comprising a screw configured to be arranged inside the waste toner container and to level the waste toner stored in the waste toner container.

7. The image forming apparatus according to claim 6, wherein when the container guide is present, the screw has two different shapes that are designed in accordance with a size/ shape of the container guide.

8. The image forming apparatus according to claim 3, wherein the container guide includes a leading edge in a curved shape.

9. The image forming apparatus according to claim 8, wherein the container guide is structured with a guide angle ($\theta g2$) and a guide width (bg2).

10. The image forming apparatus according to claim 3, wherein the container guide is located at a bottom portion of the waste toner container.

11. The image forming apparatus according to claim 1, wherein the support member serves as a bottom plate for the waste toner container.

12. The image forming apparatus according to claim 11, wherein a bottom portion of the waste toner container and the support member come in contact with each other to support the waste toner container.

13. The image forming apparatus according to claim 11, wherein the positioning unit serves as a positioning means in a y-direction position of the waste toner container, the side guide plate serves as a positioning means in an x-direction position of the waste toner container, and the support member serves as a positioning means in a z-direction position of the waste toner container.

14. The image forming apparatus according to claim 1, wherein the support member and the guide unit form a rectangular box-like shape.

15. The image forming apparatus according to claim 1, further comprising:

an image bearer; and a cleaning unit configured to remove waste toner on the image bearer.

16. The image forming apparatus according to claim 15, wherein the waste toner container is configured to store the waste toner that is removed by the cleaning device.

17. An image forming apparatus comprising:

a waste toner container configured to be detachably attached to the image forming apparatus and to store a waste toner;

a support member configured to support the waste toner container, wherein the support member is provided with a guide unit thereon that guides the waste toner container in attachment and detachment directions; and a container guide protruding from a front side of the waste toner container in the attachment direction, the waste toner container is formed by a blow molding process, and a shape of the container guide is symmetrical with respect to a parting line where the two halves of a mold, from the blow molding process, separate, the guide unit includes a side guide plate that guides each of sides of the waste toner container in the attachment and detachment directions, a guide plate arranged on entrance side of the side guide plate in the attachment direction of the waste toner container, the guide plate includes an inclined guide surface that guides the waste toner container onto the support member.

* * * * *